United States Patent [19]

Barowski et al.

[11] Patent Number: 4,691,095

[45] Date of Patent: Sep. 1, 1987

[54] HAIR ROLLER HEATING DEVICE WITH THERMOMAGNETIC ROLLER TEMPERATURE CONTROL

[75] Inventors: Karlheinz Barowski, Hattersheim; Conrad Berghammer, Kronberg/Ts, both of Fed. Rep. of Germany

[73] Assignee: Braun Aktiengesellschaft, Kronberg, Fed. Rep. of Germany

[21] Appl. No.: 768,033

[22] Filed: Aug. 21, 1985

[30] Foreign Application Priority Data

Sep. 17, 1984 [DE] Fed. Rep. of Germany ..... 3434072

[51] Int. Cl.[4] ..... A45D 2/12; A45D 4/12; H05B 1/02; H05B 3/00

[52] U.S. Cl. ..... 219/222; 132/33 R; 132/33 G; 219/242; 219/495; 219/521

[58] Field of Search ..... 219/222, 242, 495, 521; 132/33 R, 33 G

[56] References Cited

U.S. PATENT DOCUMENTS

| | | | |
|---|---|---|---|
| 3,257,541 | 6/1966 | Jorgensen | 219/222 |
| 3,328,561 | 6/1967 | Sakamoto et al. | 219/495 X |
| 3,415,254 | 12/1968 | Brock et al. | 219/222 X |
| 3,519,792 | 7/1970 | Solomon | 219/222 |
| 3,594,543 | 7/1971 | Wallin | 219/222 |
| 3,610,878 | 10/1971 | Thomas | 219/222 |
| 3,665,939 | 5/1972 | Laing | 219/242 X |
| 3,881,086 | 4/1975 | Fleischhauer | 219/495 X |
| 4,109,667 | 8/1978 | Quirk | 219/222 X |
| 4,499,355 | 2/1985 | Walter | 219/222 X |

FOREIGN PATENT DOCUMENTS

| | | | |
|---|---|---|---|
| 1965932 | 7/1971 | Fed. Rep. of Germany | 219/242 |
| 1965933 | 7/1971 | Fed. Rep. of Germany | 219/242 |

*Primary Examiner*—Anthony Bartis

[57] ABSTRACT

A hair styling device includes a hair roller that defines a conical inner chamber open at its larger end and has a jacket containing a heat storing material, a cooperating heating spindle for heating the hair roller, the heating spindle having a conical outer surface matching the inner surface of the inner chamber of the hair roller, and biasing means for causing the hair roller to rise off the heating spindle. Hair roller holding means comprises a body of ferromagnetic material carried by the hair roller adjacent the smaller end of the conical chamber and a magnet, the body of ferromagentic material being movable into the holding range of the magnet when the hair roller is placed on the heating spindle to hold the conical surfaces of the chamber of the hair roller and the heating spindle in mating engagement. The Curie temperature of the ferromagnetic material corresponds to the set temperature of the hair roller, so that when the hair roller is heated to its set temperature, the holding force of the magnet is reduced and the biasing means lifts the hair roller off the heating spindle.

13 Claims, 4 Drawing Figures

HAIR ROLLER HEATING DEVICE WITH THERMOMAGNETIC ROLLER TEMPERATURE CONTROL

The invention relates to a hair styling device. A device of this type, composed of hair rollers and an arrangement comprising a plurality of heating spindles for heating the hair rollers, is known from U.S. Pat. No. 3,415,254, each hair roller according to this prior publication comprising a bimetallic locking element which locks it to the heating spindle of the heating arrangement until it reaches a predetermined set temperature corresponding to the optimum hair setting temperature. When this set temperature is exceeded, the bimetallic latch is released, and the hair roller is lifted off the heating spindle by a pretensioned spring.

Although this known arrangement already differs advantageously from the state of the art, wherein sufficient heating of the hair rollers, by steam for example, was not possible at all or at least a hair setting temperature recognized as optimal could not be generated reproducibly, it was likewise not completely satisfactory because its mechanical bimetallic latch could be adjusted precisely only at considerable technical expense, and the accuracy of the response of this latch necessarily suffered in the course of time as a result of wear phenomena.

It is true that U.S. Pat. No. 4,109,667 has already disclosed a hair styling device wherein the temperature dependence of the attractive force of a magnet on a ferromagnetic material, disposed in the hair roller, with a Curie point was utilized to limit the heating of the hair rollers, but in this known device each individual hair roller used had to be provided with an electric heater, which then had to be connected to a power source by physical contact in a heating station, and therefore this device required such a high manufacturing cost that it was not competitive with other, known solutions. In addition, its functional reliability in the long term could be severely affected adversely by mechanical wear and aging of the electrical contacts.

The goal was therefore to provide a hair styling device composed of hair rollers and a heating station, which did not suffer from the disadvantages and shortcomings described, and which therefore ensured heating, accurate in the long term, of the hair rollers to the prescribed set temperature at minimum cost. The heating device should also be as small as possible and portable, yet efficient in terms of its heating ability. In addition, it should be possible to heat hair rollers of different diameters, as used to produce curls of different sizes, on a single heating spindle with no difficulty whatever.

A hair styling device according to the present invention includes a hair roller that defines a conical inner chamber open at its larger end and has a jacket containing a heat storing material, a cooperating heating spindle for heating the hair roller, the heating spindle having a conical outer surface matching the inner surface of the inner chamber of the hair roller, biasing means for causing the hair roller to rise off the heating spindle, and hair roller holding means comprising a body of ferromagnetic material carried by the hair roller adjacent the smaller end of the conical chamber and a magnet, the body of ferromagnetic material being movable into the holding range of the magnet when the hair roller is placed on the heating spindle to hold the conical surfaces of the chamber of the hair roller and the heating spindle in mating engagement. The Curie temperature of the ferromagnetic material corresponds to the set temperature of the hair roller, so that when the hair roller is heated to its set temperature, the holding force of the magnet is reduced and the biasing means lifts the hair roller off the heating spindle. The magnetic holding arrangement ensures that the biasing means, which is preferably a spring that tensioned as the hair roller is placed on the heating spindle, is initially held in the tensioned state and that this spring lifts the hair roller off the heating spindle, thus terminating the heating of the hair roller, when the latter has reached its set temperature. Since alloys with very precisely settable Curie points are available today and can be obtained in almost any shape practical for the present application, there are no limits to the structural design or the hair-setting temperatures achievable thereby, and the present invention provides a highly cost-effective hair styling device in which hair rollers can be heated in an elegant manner, precisely and reliably, and always to the same predetermined set temperature.

It has been found to be especially advantageous to dispose the magnet at the free end of the heating spindle and the magnetizable body on the corresponding end of the hair roller, so that these two cooperating parts are located immediately opposite and adjacent to one another when the hair roller is placed on the heating spindle. This central location for the retaining means offers considerable manufacturing and assembly advantages and also especially reliably ensures that the magnetic attractive force, which decreases as the ferromagnetic body is heated, drops below the opposing force of the tensioned spring in a reproducible manner, consequently causing the hair roller to rise off the heating spindle precisely when the heat-storing core of the hair roller has been uniformly heated to the predetermined set temperature. The action of the magnet can be improved in known fashion by providing it with a so-called "iron feedback."

One critical advantage of the present invention over known hair roller heating arrangements, especially also over the arrangement described in U.S. Pat. No. 3,415,254, is that the magnetic locking of the hair roller to the conical heating spindle according to the invention always creates an optimal heating contact between the heating spindle and the hair roller, one which is moreover largely independent of difficult-to-maintain manufacturing tolerances, wear, and heating of the material. This effect is achieved by the fact that the magnet pulls the hair roller during each heating process onto the heating spindle until the conical inner face of the hair roller is flush with the precisely matching conical jacket of the heating spindle.

The spring which is affected by the forcing apart of the ferromagnetic body disposed in the hair roller and the magnet to lift the hair roller off the heating spindle preferably abuts, on the one hand, the lower end of the heating spindle or a portion of the housing supporting the latter, and on the other hand, the lower end of any hair roller mounted on the heating spindle in question. However, according to another advantageous embodiment of the invention, the spring is mounted directly between the magnet and the ferromagnetic body, the magnet being fastened to the lower end of the spring, opposite the ferromagnetic body, so that the magnet is fastened by means of the spring to the hair roller and comes to rest on the heating spindle when the hair roller is placed on the heating spindle.

A special advantage of the present invention is that hair rollers with extremely different outside diameters can be heated on a given heating spindle precisely to the set temperature predetermined by the Curie temperature of the ferromagnetic bodies contained in them. In addition, the present invention can also be advantageously designed so that it includes differently heatable hair rollers for the hair styling device, for example those of the same diameter, which differ in the Curie temperatures of the ferromagnetic bodies contained in them and can be distinguished externally, for example, by their color.

The heating spindles are heated according to the present invention preferably by electrically operated PTC resistances which, as a result of their known temperature-dependent resistance characteristic curve, limit the heating of the heating spindles in a self-regulating manner, so that no additional temperature regulation is required. In one advantageous embodiment, a heating element is located beneath each heating spindle in such fashion that it rests flush in a heat-conducting manner with its top directly on the base of the heating spindle, and is supported under spring tension at its base to accommodate its thermal expansion. Another advantageous embodiment, especially as regards the desired high heating rate, is characterized by the conical heating spindles having matching lengthwise recesses disposed coaxially to the lengthwise axes of the spindles, in which recesses suitably shaped heating elements are positively mounted by press-fitting.

Alternatively, the heating spindles can also be heated by means of heating elements which contain devices for thermostatically regulated catalytic combustion of a flammable gas. In this embodiment the hair styling device according to the invention can be used completely independently, so that it can be used on trips or in locations without any connection to an electrical power source; in addition, it completely eliminates the residual risk, which in theory cannot be completely ruled out when using line-operated electrical appliances, when improperly used in wet areas.

One embodiment of the present invention, marked by especially advantageous use, is characterized by the heating elements and their regulation being so arranged—i.e., constructed and adjusted—and so dimensioned that they continuously heat the heating spindles to a temperature which is at least 100 degrees Celsius above the set temperature of the hair rollers. This ensures that the heating spindles are not only preheated when the hair rollers are placed on them, but are quite considerably overheated relative to their set temperature, so that the heating process for the hair rollers occurs in the shortest possible time, i.e. within a few seconds. This embodiment can be advantageously modified by having it comprise only a single heating spindle, because it has been found that the latter, as a result of the extremely short heating time of the hair rollers provided by the overheating, is readily capable, even with swift operation, of sufficiently rapidly bringing one hair roller after the other to its set temperature. This also provides significant savings in the manufacturing costs of the heating unit as well as small dimensions for the appliance and low weight.

To avoid energy losses through heat radiation and convection, it is also proposed to surround the heating spindle laterally by a heat-insulating and/or heat-reflecting partition with a space to allow the hair rollers to be slipped on. At the same time, this measure prevents burns caused by accidentally touching the overheated heating spindle. To avoid burns at the exposed end of the heating spindle, the end is preferably fitted with a protector in the form of a heat-insulating, heat-resistant cap or plate.

The attached drawing shows the present invention in the form of simplified embodiments:

Figure 1:
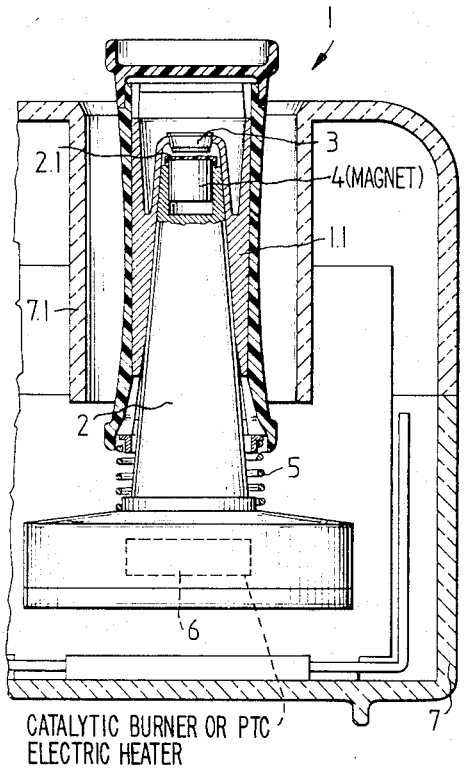
FIG. 1 shows a hair roller mounted on a heating spindle during the heating process.

In detail, FIG. 1 shows the hair roller 1, comprising a body 3 made of ferromagnetic material in the vicinity of its upper end, and pushed onto a heating spindle 2 by pressing down lightly against the force of an elastic spring 5, so that it is held in this position by the force exerted by a magnet 4, located in the free end of heating spindle 2, on ferromagnetic body 3.

Figure 2:
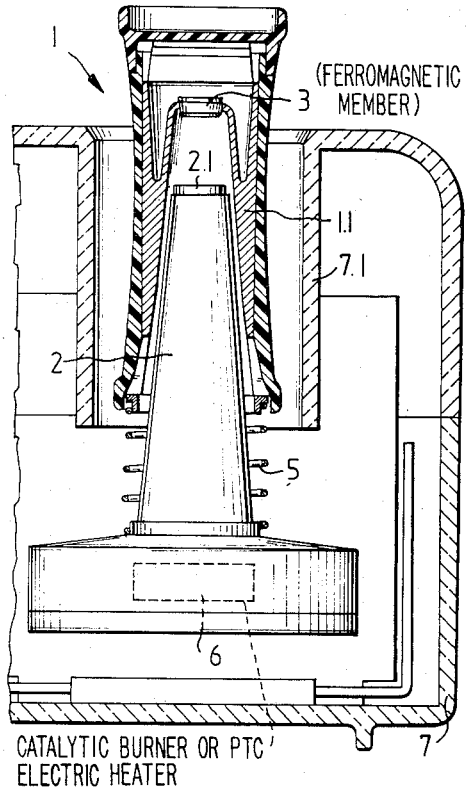
FIG. 2 shows the hair roller lifted off the heating spindle after reaching its set temperature.

Heating element 6 is disposed in the embodiment shown at the base of heating spindle 2 and may be a PTC heating resistance or a device for thermally regulated catalytic combustion of a flammable gas. As soon as heating element 6 via spindle 2 heats hair roller 1—i.e., especially its core 1.1 composed of heat-storing material—finally also heats ferromagnetic body 3 to its Curie temperature and thus to the set temperature of the hair roller, the magnet 4 loses its effect on body 3, and spring 5 lifts hair roller 1 off the heating spindle, whereupon hair roller 1 assumes the position shown in FIG. 2, in which it is no longer heated since its direct thermal contact with the heating spindle has been completely interrupted.

Spindle 2 with heating element 6 located at its base is permanently attached to the interior of a housing 7 by means of structural elements not shown in the drawing. Parts 7.1 of the housing wall, which surround the heating spindle at a distance sufficient to allow the hair rollers to be slipped on and off, are made heat-insulating and/or heat-reflecting, thereby limiting heat losses caused by radiation and convection. In addition, the housing surrounding heating spindle 2, together with the protective cap 2.1 mounted on the end of the heating spindle, protects a user of the device according to the invention from burns caused by accidental contact with the heated spindle.

Figure 3:
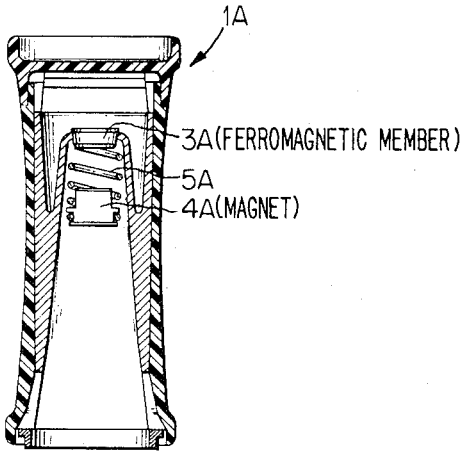
FIG. 3 shows a hair roller that differs from the embodiment in the first two figures as regards the arrangement of the magnet and lifting spring.

FIG. 3 shows another embodiment of the present invention wherein the magnet 4A is fastened to the hair roller 1A by a compressible lift spring 5A between the magnet 4A and the ferromagnetic body 3A and is brought into contact with the ferromagnetic body when the roller 1A is placed on the heating spindle 2.

In order to make optimal use of the advantages achievable with the hair styling device according to the invention and of its embodiments, it is also proposed that it always be operated so that the heating spindle or heating spindles be heated during the entire operating time of the device, without interruption, to a temperature significantly above the set temperature of the hair rollers. Here the expression "significantly above the set temperature of the hair rollers" means temperatures which are at least above the hair-damaging temperature and for this reason are usually not considered for heating hair rollers. Preferably, however, the continuous temperature of the heating spindles used in the proposed method of operation is at least 100 degrees Celsius above the set temperature of the hair rollers, for example at 300 degrees Celsius.

Figure 4:
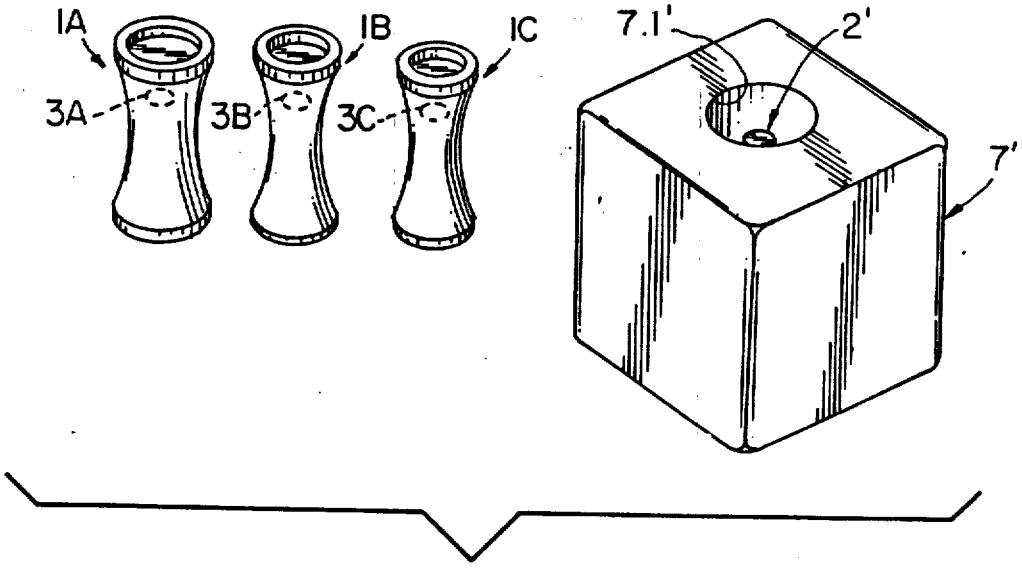
FIG. 4 shows a perspective view of a plurality of hair rollers and hair associated heating housing.

FIG. 4 shows a perspective of a heater housing 7' with spindle 2' located in housing opening 7.1', together with associated spindles 1A, 1B, 1C that have different outside diameters. Spindles 1A, 1B and 1C are also differently heatable as the Curie temperatures of their ferromagnetic bodies 3A, 3B, 3C are different.

We claim:

1. A hair styling device composed of a hair roller and heatable spindle structure for heating said hair roller, said hair roller comprising a jacket containing a heat storing material and structure forming a heat exchange surface for supplying heat to the heat storing material and defining a conical inner chamber open at its larger end, said heatable spindle structure adapted to be inserted into mating heat exchange engagement with said inner chamber of said roller and having structure defining a conical outer surface matching the surface of the conical inner chamber of said hair roller, biasing means associated with one of said roller and spindle structure for lifting said hair roller out of heating engagement with said heatable spindle structure, and holding means for stressing said biasing means when said hair roller is placed on said heatable spindle and preventing said hair roller from being lifted out of engagement with said heatable spindle structure by the action of said stressed biasing means, said holding means comprising a body of ferromagnetic material disposed on said hair roller and a magnet, said body of ferromagnetic material being moved into the holding range of said magnet in response to said hair roller being placed on said heatable spindle structure to hold said biasing means in its stressed condition, the Curie temperature of said body of ferromagnetic material corresponding to the set temperature of said hair roller so as to release said biasing means at said temperature, and means for heating said heatable spindle structure.

2. Hair styling device according to claim 1 wherein said magnet is fastened to the free end of said heatable spindle structure and said ferromagnetic body is secured to the corresponding end of said hair roller.

3. Hair styling device according to claims 1 or 2 wherein said biasing means is a spring which forces said magnet and said ferromagnetic body apart, thereby lifting said hair roller out of engagement with said heating spindle structure, said spring abutting, on the one hand, the lower end of said heatable spindle structure and, on the other hand, the lower end of the hair roller mounted on said heatable spindle structure.

4. Hair styling device according to claim 1, wherein said magnet is fastened to said hair roller by means of a compressible lift spring defining said biasing means opposite said ferromagnetic body in such fashion that said magnet comes in contact with said ferromagnetic body in response to said hair roller being placed on said heatable spindle structure.

5. Hair styling device according to any one of claims 1, 2 or 4 wherein said device has a plurality of hair rollers heatable to different temperatures, said hair rollers containing ferromagnetic bodies with different Curie temperatures.

6. Hair styling device according to claim 1 wherein said spindle structure heating means includes an electrically powered heating element with positive temperature coefficient characteristics (PTC) for heating said heatable spindle structure.

7. Hair styling device according to one of claims 1, 2 or 4 wherein said spindle structure heating means includes a thermostatically regulated heating element for heating said spindle structure, said heating element being heated by catalytic combustion of a flammable gas.

8. Hair styling device according to claim 1 wherein the free end of said heating spindle structure has a heat-resistant cap as protection against contact therewith.

9. Hair styling device according to one of claims 1, 2 or 4 wherein said spindle structure heating means is so dimensioned and arranged that said heating means continuously heats said heating spindle structure to a temperature at least 100 degrees Celsius above the set temperature of said hair roller.

10. Hair styling device according to claim 9, characterized by comprising only a single heating spindle structure (2).

11. Hair styling device according to claim 10 and further including a heat-insulating and/or heat-reflecting partition laterally surrounding said heatable spindle structure at a distance which allows said hair roller to be placed on said heatable spindle structure.

12. A method of operating a hair styling device composed of a hair roller and heatable spindle structure for heating the hair roller, said hair roller comprising a jacket containing a heat storing material and structure defining an inner chamber open at one end, said heatable spindle structure adapted to be inserted into mating engagement with said inner chamber of said roller and having structure defining a outer surface matching the surface of the inner chamber of said hair roller, biasing means for lifting said hair roller from said heatable spindle structure, temperature responsive holding means comprising a body of ferromagnetic material disposed on said hair roller and a magnet, the Curie temperature of said body of ferromagnetic material corresponding to the set temperature of said hair roller, said temperature responsible holding means stressing said biasing means in response to said hair roller being placed on said heatable spindle structure and preventing said hair roller from being lifted out of engagement with said heatable spindle structure by the action of the biasing means, comprising the steps of continuously heating said spindle structure to a temperature above the set temperature of the hair roller, and placing said hair roller on said heatable spindle structure, said body of ferromagnetic material being moved into the holding range of said magnet in response to said hair roller being placed on such heatable spindle structure to tension said biasing means.

13. The method of claim 12 wherein said spindle is continuously heated to a temperature at least 100 degrees Celsius above the set temperature of said hair roller.

* * * * *

UNITED STATES PATENT AND TRADEMARK OFFICE

CERTIFICATE OF CORRECTION

PATENT NO. : 4,691,095

DATED : September 1, 1987

INVENTOR(S) : Karlheinz Barowski, et al

It is certified that error appears in the above-identified patent and that said Letters Patent is hereby corrected as shown below:

Insert figure 4 as shown on the attached sheet.

Signed and Sealed this

Sixteenth Day of February, 1988

*Attest:*

*Attesting Officer*

DONALD J. QUIGG

*Commissioner of Patents and Trademarks*